US010168028B2

(12) United States Patent
Hsu

(10) Patent No.: US 10,168,028 B2
(45) Date of Patent: Jan. 1, 2019

(54) LAMP

(71) Applicant: DONGGUAN JIA SHENG LIGHTING TECHNOLOGY COMPANY LIMITED, Dongguan (CN)

(72) Inventor: Shui-Sheng Hsu, Dongguan (CN)

(73) Assignee: DONGGUAN JIA SHENG LIGHTING TECHNOLOGY COMPANY LIMITED, Dongguan (CN)

( * ) Notice: Subject to any disclaimer, the term of this patent is extended or adjusted under 35 U.S.C. 154(b) by 77 days.

(21) Appl. No.: 15/365,688

(22) Filed: Nov. 30, 2016

(65) Prior Publication Data

US 2017/0363274 A1 Dec. 21, 2017

(30) Foreign Application Priority Data

Jun. 21, 2016 (CN) ..... 2016 2 0633960 U

(51) Int. Cl.
*F21V 15/01* (2006.01)
*F21V 17/16* (2006.01)
(Continued)

(52) U.S. Cl.
CPC ..... *F21V 17/162* (2013.01); *F21S 8/063* (2013.01); *F21V 3/02* (2013.01); *F21V 7/00* (2013.01);
(Continued)

(58) Field of Classification Search
CPC ..... F21V 21/14; F21V 21/10; F21V 21/02; F21V 21/112; F21V 17/162; F21V 23/06; F21V 23/001; F21V 29/70; F21V 3/02; F21V 7/00; F21V 2115/10; F21V 15/01; F21V 3/00; F21V 17/164; F21V 21/30; F21V 19/007; F21V 19/0005; F21Y 2115/10; F21Y 2103/33; F21S 8/02; F21S 8/026
See application file for complete search history.

(56) References Cited

U.S. PATENT DOCUMENTS 4,745,533 A * 5/1988 Smerz ..... F21S 8/02 362/364
5,136,490 A * 8/1992 Morrison ..... F21S 8/06 362/294

(Continued)

*Primary Examiner* — Anh T Mai
*Assistant Examiner* — Fatima N Farokhrooz
(74) *Attorney, Agent, or Firm* — Platinum Intellectual Property LLP

(57) ABSTRACT

A lamp includes a main body, a lighting assembly, a lampshade assembly, and a reflector cover. The main body includes a heat sink and a lamp holder, the bottom of the heat sink extends outwardly to form a flange, the lamp holder has a trumpet shaped structure, a bottom of the lamp holder has a minor axis along a longitudinal direction and a major axis along a transverse direction. The lighting assembly is mounted to the bottom of the lamp holder. The lampshade assembly includes a cover body covering the lamp holder and a spring located in the cover body. The reflector cover includes a sleeving portion and an embedded portion, an inner diameter of the embedded portion is less than the major axis of the bottom of the lamp holder, and is greater than the minor axis.

10 Claims, 8 Drawing Sheets

(51) Int. Cl.

| | |
|---|---|
| ***F21V 29/70*** | (2015.01) |
| ***F21V 3/02*** | (2006.01) |
| ***F21V 7/00*** | (2006.01) |
| ***F21V 23/00*** | (2015.01) |
| ***F21V 23/06*** | (2006.01) |
| ***F21S 8/06*** | (2006.01) |
| *F21Y 115/10* | (2016.01) |
| *F21V 3/00* | (2015.01) |
| *F21Y 103/33* | (2016.01) |

(52) U.S. Cl.
CPC ..... *F21V 15/01* (2013.01); *F21V 23/001* (2013.01); *F21V 23/06* (2013.01); *F21V 29/70* (2015.01); *F21V 3/00* (2013.01); *F21Y 2103/33* (2016.08); *F21Y 2115/10* (2016.08)

(56) References Cited

U.S. PATENT DOCUMENTS

2011/0164422 A1* 7/2011 Chan ..... F21V 14/04 362/284
2014/0268722 A1* 9/2014 Holland ..... F21V 21/096 362/218
2014/0307450 A1* 10/2014 Cho ..... F21V 21/04 362/364
2015/0015152 A1* 1/2015 Aboulnaga ..... H05B 33/0815 315/200 R
2015/0276136 A1* 10/2015 Liang ..... F21V 29/70 362/285
2017/0343190 A1* 11/2017 Georgiev ..... F21V 14/06

* cited by examiner

LAMP

FIELD OF THE INVENTION

The present disclosure relates to lightings, and more particularly relates to a lamp with a self-locking reflector cover.

BACKGROUND OF THE INVENTION

In conventional lamp, when a reflector cover is assembled, the reflector cover is generally mounted to a lamp holder by a threaded connection. There is a rolling operation in the locking process. However, in the process of the rolling operation, in order to prevent from being driven synchronously, the lamp holder or the reflector cover is required to be held, thus it is inconvenient for assemble or dismantle operation, and a risk of rupture exists due to different locking power of individuals.

SUMMARY

Accordingly, it is necessary to provide a lamp that is convenient to assembly and disassembly.

A lamp includes: a main body including a heat sink and a lamp holder located on a bottom of the heat sink, wherein the bottom of the heat sink extends outwardly to form a flange, the lamp holder has a trumpet shaped structure, a bottom of the lamp holder has a shape as an ellipse having a minor axis along a longitudinal direction and a major axis along a transverse direction; a lighting assembly mounted to the bottom of the lamp holder; a lampshade assembly including a cover body covering the lamp holder and a spring located in the cover body, wherein a first end of the cover body resists a top of the flange, a first end of the spring resists a bottom of the flange, a second end of the spring resists a second end of the cover body; and a reflector cover, wherein a top end of the reflector cover includes a sleeving portion extending radically and an embedded portion axially extending upward from an inner edge of the sleeving portion, an inner diameter of the embedded portion is less than the major axis of the bottom of the lamp holder, and is greater than the minor axis; when assembly, the cover body is moved upwardly relative to the main body to compress the spring, the reflector cover is inclined toward the main body for a determined angle and is moved to sleeve on the lamp holder, until the bottom of the lamp holder is embedded into the sleeving portion of the reflector cover, and then the reflector cover is rotated to a right position, when the cover body is released and subjected to a reversed thrust of the spring, then the cover body moves downwardly to resist the reflector cover, thereby securing the top end of the reflector cover.

A lamp includes: a main body including a heat sink and a lamp holder located on a bottom of the heat sink, wherein the bottom of the heat sink extends outwardly to form a flange, the lamp holder has a trumpet shaped structure, a bottom of the lamp holder has a shape as an ellipse having a minor axis along a longitudinal direction and a major axis along a transverse direction; a lighting assembly mounted to the bottom of the lamp holder; a lampshade assembly including a cover body covering the lamp holder and a spring located in the cover body, wherein the spring surrounds the lamp holder, the cover body includes a first end and a second end opposite to the first end, the first end and the second end each extends inwardly to form an annular portion, an inner diameter of the second end of the cover body is greater the major axis of the bottom of the lamp holder, the first end of the cover body resists a top of the flange, the spring is clamped between the flange and the second end of the cover body; and a reflector cover, wherein a top end of the reflector cover includes a sleeving portion extending radically and an embedded portion axially extending upward from an inner edge of the sleeving portion, an inner diameter of the embedded portion is less than the major axis of the bottom of the lamp holder, and is greater than the minor axis, which facilitates the lamp holder to extend into the reflector cover when the embedded portion is inclined for a predetermined angle.

In the lamp, the reflector cover is inclined toward the lamp holder for a predetermined angle and is sleeved on the bottom of the lamp holder, and takes advantage of the spring in the cover body to enable the cover body to move up and down flexibly relative to the main body, thereby the cover body can elastically secure the reflector cover beneath the bottom of the lamp holder, thus a convenient assembly and dismantle operation of the reflector cover can be realized without a controlling of a locking power.

DETAILED DESCRIPTION OF THE EMBODIMENTS

Embodiments of the invention are described more fully hereinafter with reference to the accompanying drawings, in which preferred embodiments of the invention are shown. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
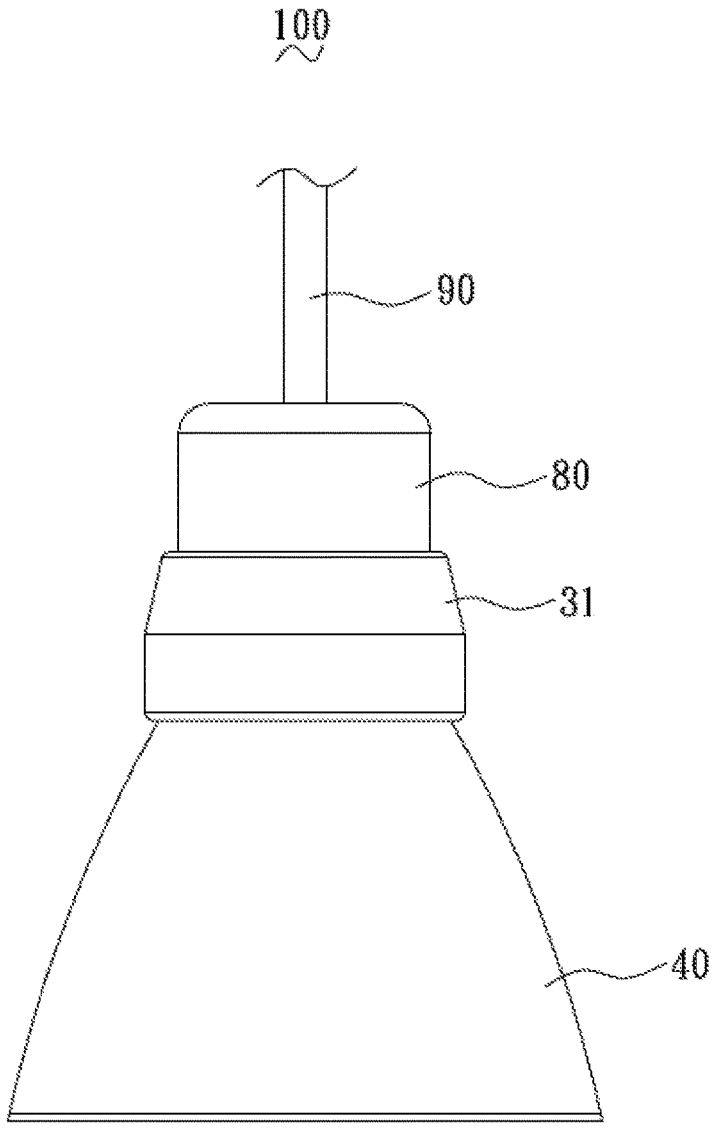
FIG. 1 is a perspective view of a lamp according to an embodiment of the invention.
Figure 2:
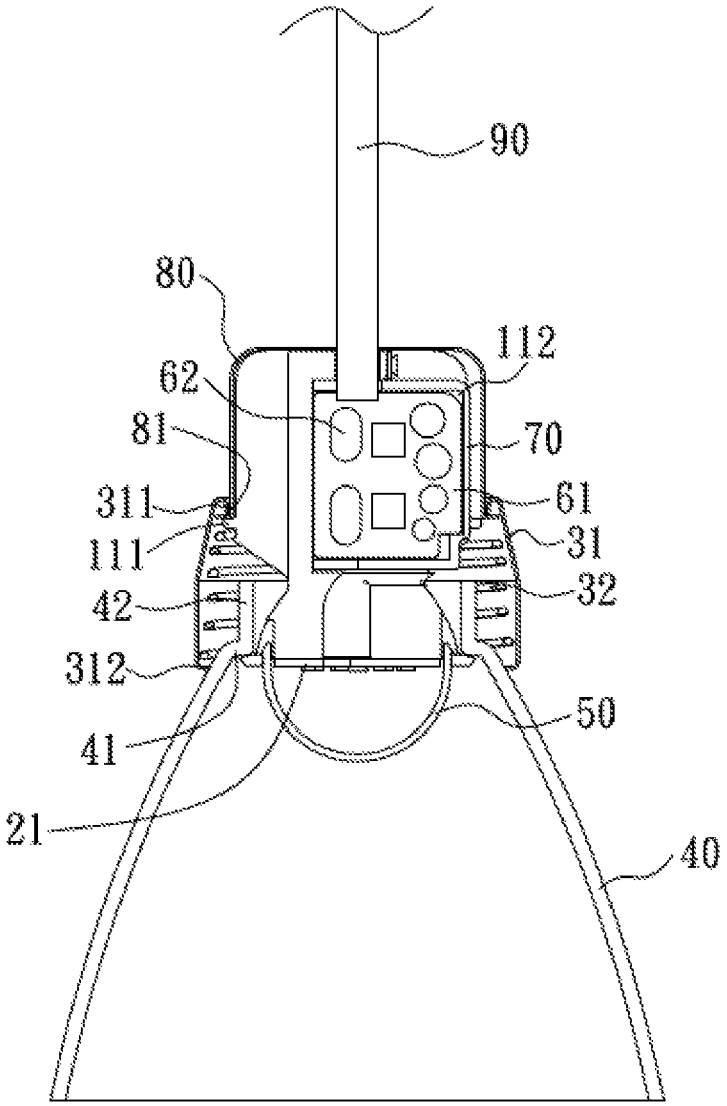
FIG. 2 is a cross-sectional view of the lamp of FIG. 1.
Figure 3:
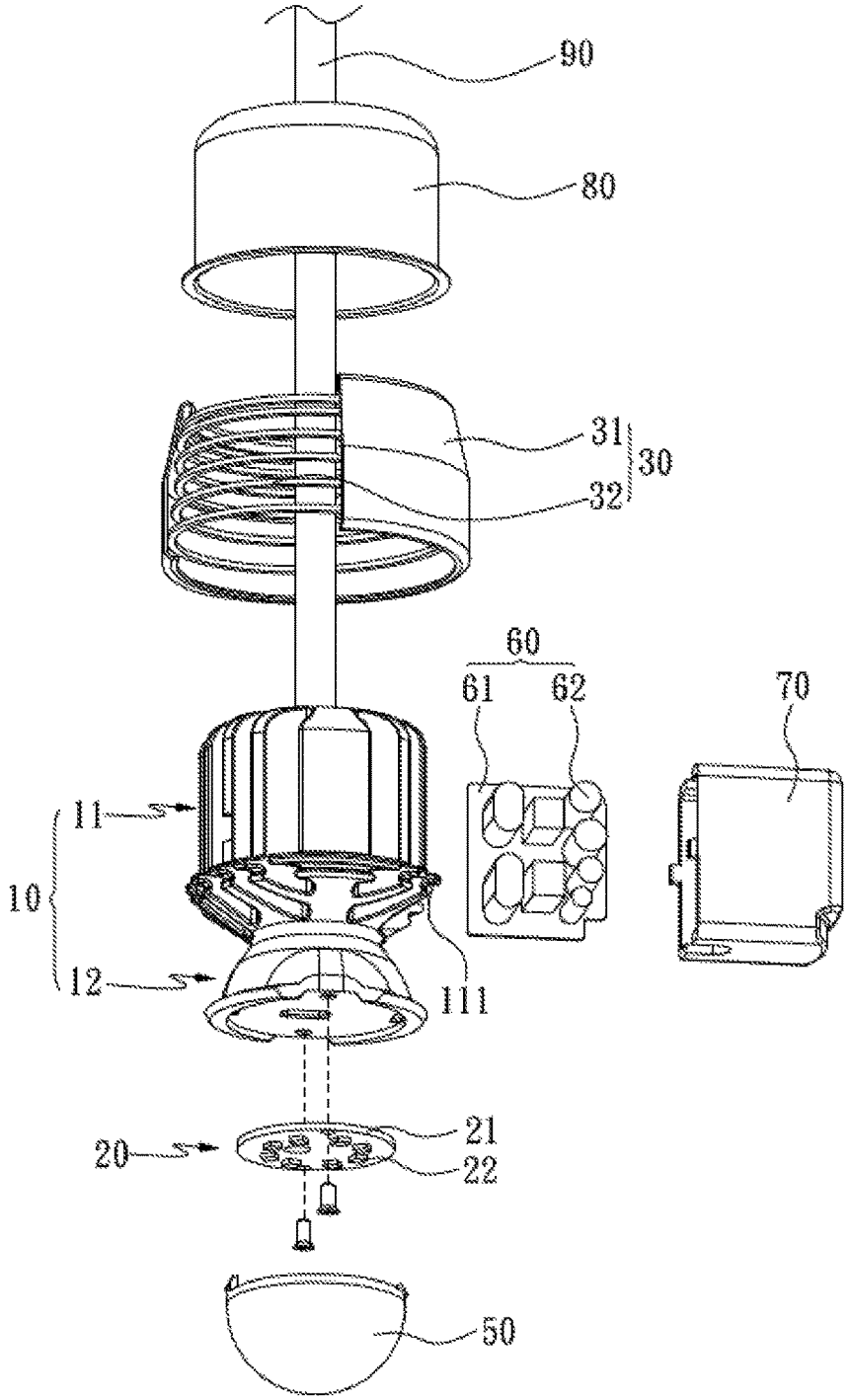
FIG. 3 is an exploded view of the lamp of FIG. 1.
Figure 4:
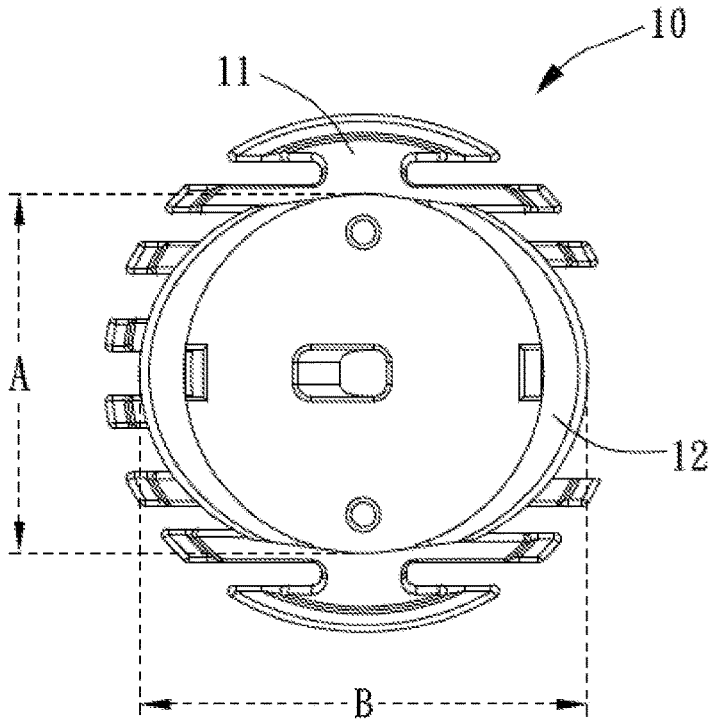
FIG. 4 is a top view of a main body of FIG. 3.
Figure 5:
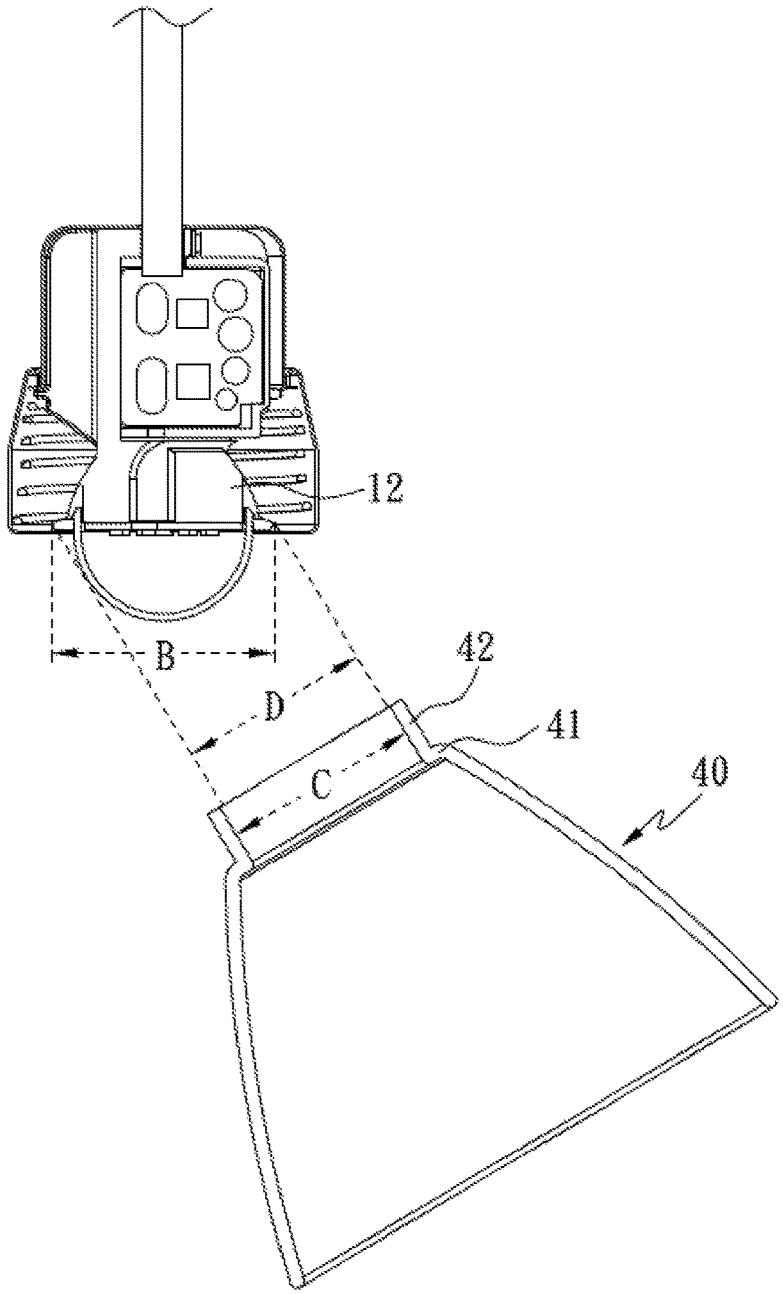
FIG. 5 is a cross-sectional view of a lamp when a reflector cover is disassembled and in a heeling condition.
Figure 6:
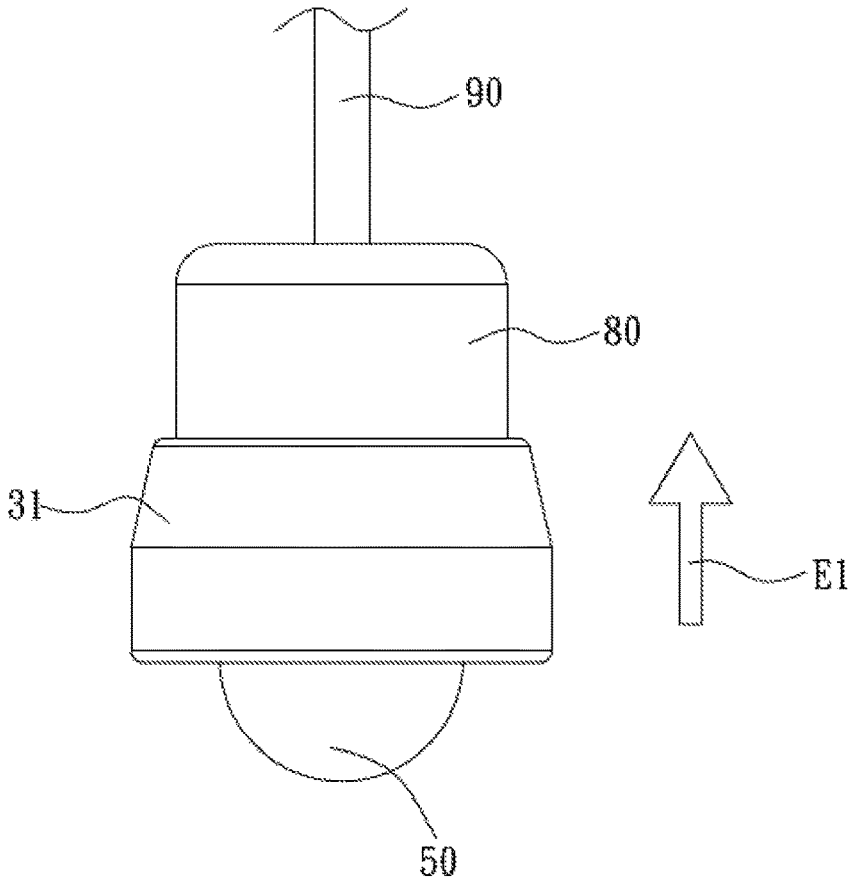
FIG. 6 is a perspective view of an operation that moving a reflector cover upward relative to a main body.
Figure 7:
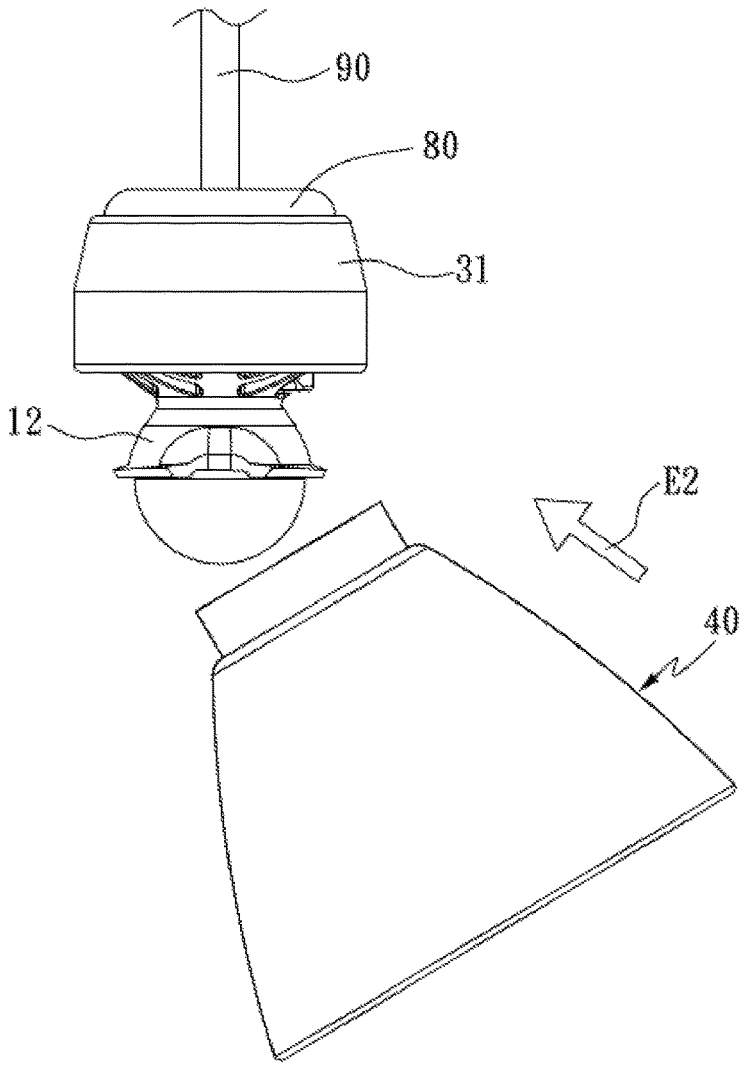
FIG. 7 is a perspective view of an operation that moving a reflector cover to sleeve on a lamp holder after the reflector cover is inclined for a determined angle toward a main body.
Figure 8:
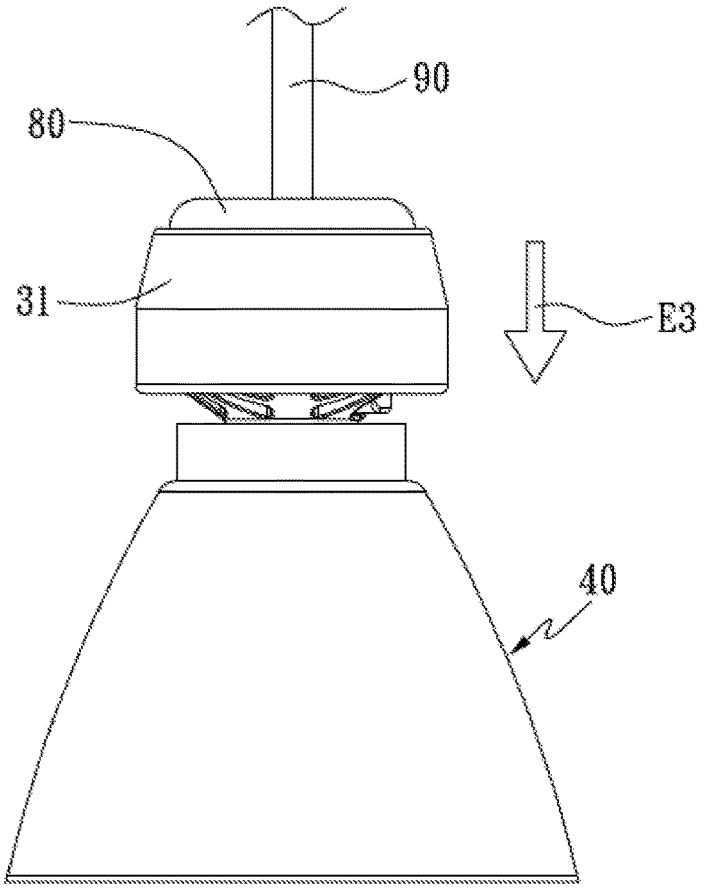
FIG. 8 is a perspective view of a cover body that is released and moved downward.

As shown in FIG. 1 through FIG. 8, a lamp 100 according to an embodiment includes a main body 10, a lighting assembly 20, a lampshade assembly 30, a reflector cover 40, a light transmissive lampshade 50, a control module 60, a connection wire (not shown), a protection housing 70, a heat dissipation cover 80, and a wiring pipe 90.

The main body 10 include a heat sink 11 and a lamp holder 12 positioned on a bottom of the heat sink 11. The bottom of the heat sink 11 extends outwardly to form a flange 111. The lamp holder 12 has a trumpet shaped structure, a profile of a bottom of the lamp holder 12 is substantially ellipse shaped. The bottom of the lamp holder 12 has a minor axis A along a longitudinal direction and a major axis B along a transverse direction, i.e. a length of the minor axis A is less than a length of the major axis B. In the embodiment, the heat sink 11 and the lamp holder 12 are designed to be integrally formed. In other embodiments, the lamp holder 12 and the heat sink 11 are connected by a threaded connection or a latch to realize an assembly.

The heat sink 11 defines a receiving groove 112 at a side thereof, the control module 60 includes a PCB board 61 and an electronic component 62 distributed on the PCB board 61, the PCB board 61 and the electronic component 62 are located in the receiving groove 112. The protection housing 70 is latched in the receiving groove 112, the control module 60 is located in the protection housing 70.

The lighting assembly 20 includes an assembly plate 21 and a plurality of LED lamps 22 distributed on the assembly plate 21. For example, the assembly plate 21 is mounted to the bottom of the lamp holder 12 via a threaded fastener. For another example, the assembly plate 21 is mounted to the bottom of the lamp holder 12 in a stick way. Preferably, the assembly plate 21 is a printed circuit board. The light transmissive lampshade 50 is latched on the bottom of the lamp holder 12.

In order to establish an electrical connection between the lighting assembly 20 and the control module 60, the receiving groove 112 defines a passage extending through the lamp holder 12. The connection wire extends through the passage, to enable opposite ends of the connection wire to electrically connect the lighting assembly 20 and the control module 60.

The lampshade assembly 12 includes a cover body 31 covering the lamp holder 12 and a spring 32 located in the cover body 31. The spring 32 surrounds the lamp holder 12. A first end of the cover body 31 resists a top of the flange 111, a first end of the spring 32 resists a bottom of the flange 111, a second end of the spring 32 resists a second end of the cover body 31.

The first end of the cover body 31 extends inwardly to form a first annular portion, the second end of the cover body 31 extends inwardly to form a second annular portion. Specifically in the embodiment, the first annular portion is a first bending edge 311 formed by an edge of the first end of the cover body 31 extending inwardly, the first bending edge 311 resists the top of the flange 111 to provide a function of preventing the cover body 31 from disengaging. The second annular portion is a second bending edge 312 formed by an edge of the second end of the cover body 31 extending inwardly, the second end of the spring 32 resists the second bending edge 311 to provide a function of preventing the spring 32 from disengaging the cover body 31.

The heat dissipation cover 80 covers the heat sink 11, an edge of a first end of the heat dissipation cover 80 is bended outwardly to form a bending portion 81. The bending portion 81 resists the top of the flange 111, the first bending edge 311 of the cover body 31 resists the bending portion 81. A second end of the heat dissipation cover 80 defines a through hole for the wiring pipe 90 extending through, an end of the wiring pipe 90 extends through the through hole and is fixed to the top of the heat sink, and is in communication with the receiving groove 112, such that external supplying lines can extend through the wiring pipe 90 to establish an electrical connection between the external supplying lines and the control module 60.

A top end of the reflector cover 40 includes a sleeving portion 41 extending radically and an embedded portion 42 axially extending upward from an inner edge of the sleeving portion 41. An inner diameter C of the embedded portion 42 is less than the major axis B of the bottom of the lamp holder 12, and is greater than the minor axis A.

Referring to FIG. 5 through FIG. 8, when assembling, the cover body 31 is moved upwardly relative to the main body 10 along a E1 direction, for easily compressing the spring 32. Further, the reflector cover 40 is inclined toward the main body 10 for a determined angle and is moved along a E2 direction to sleeve on the lamp holder 12, until the bottom of the lamp holder 12 is embedded into the sleeving portion 41 of the reflector cover 40, and then the reflector cover 40 is rotated to a right position. When the cover body 31 is released and subjected to a reversed thrust of the spring 32, then the cover body 31 moves along a E3 direction downwardly to resist the reflector cover 40, thereby securing the top end of the reflector cover 40. It should be noted that, when the reflector cover 40 is inclined toward the main body 10 for a determined angle, a projection of the inner diameter C of the embedded portion 42 on the major axis B is greater than the major axis B of the bottom of the lamp holder 12, thus the reflector cover 40 can be sleeved on the bottom of the lamp holder 12 along an inclined direction of the lamp holder 12.

In the lamp 100 according to the embodiment, the reflector cover 40 is inclined toward the lamp holder 12 for a predetermined angle and is sleeved on the bottom of the lamp holder 12, and takes advantage of the spring 32 in the cover body 31 to enable the cover body 31 to move up and down flexibly relative to the main body 10, thereby the cover body 31 can elastically secure the reflector cover 40 beneath the bottom of the lamp holder 12, thus a convenient assembly and dismantle operation of the reflector cover 40 can be realized without a controlling of a locking power.

The above are several embodiments of the present invention described in detail, and should not be deemed as limitations to the scope of the present invention. It should be noted that variations and improvements will become apparent to those skilled in the art to which the present invention pertains without departing from its spirit and scope. Therefore, the scope of the present invention is defined by the appended claims.

What is claimed is:

1. A lamp, comprising:

a main body comprising a heat sink and a lamp holder located on a bottom of the heat sink, wherein the bottom of the heat sink extends outwardly to form a flange, the lamp holder has a trumpet shaped structure, a bottom of the lamp holder has a shape as an ellipse having a minor axis along a longitudinal direction and a major axis along a transverse direction;

a lighting assembly mounted to the bottom of the lamp holder;

a lampshade assembly comprising a cover body covering the lamp holder and a spring located in the cover body, wherein a first end of the cover body resists a top of the flange, a first end of the spring resists a bottom of the flange, a second end of the spring resists a second end of the cover body; and a reflector cover, wherein a top end of the reflector cover comprises a sleeving portion extending radically and an embedded portion axially extending upward from an inner edge of the sleeving portion, an inner diameter of the embedded portion is less than the major axis of the bottom of the lamp holder, and is greater than the minor axis;

when assembled, the cover body is moved upwardly relative to the main body to compress the spring, the reflector cover is inclined toward the main body for a predetermined angle and is moved to sleeve on the lamp holder, until the bottom of the lamp holder is embedded into the sleeving portion of the reflector cover, and then the reflector cover is rotated to a right position, when the cover body is released and subjected to a reversed thrust of the spring, then the cover body moves downwardly to resist the reflector cover, thereby securing the top end of the reflector cover; and wherein, at the predetermined angle, a projection of the inner diameter of the embedded portion is greater than the major axis of the bottom of the lamp holder so that the reflector cover can be sleeved on the bottom of the lamp holder.

2. The lamp according to claim 1, further comprising a control module and a connection wire, wherein the heat sink defines a receiving groove at a side thereof, the control module is located in the receiving groove, the receiving groove has a passage extending through the lamp holder, the connection wire extends through the passage and is electrically connected to the lighting assembly and the control module, respectively.

3. The lamp according to claim 2, wherein the control module comprises a PCB board and an electronic component distributed on the PCB board.

4. The lamp according to claim 2, wherein the lighting assembly comprises an assembly plate and a plurality of LED lamps distributed on the assembly plate.

5. The lamp according to claim 2, further comprising a protection housing latched in the receiving groove, wherein the control module is located in the protection housing.

6. The lamp according to claim 2, further comprising a wiring pipe, wherein an end of the wiring pipe is fixed to a top of the heat sink, and is in communication with the receiving groove.

7. The lamp according to claim 6, further comprising a heat dissipation cover covering the heat sink, wherein an edge of a first end of the heat dissipation cover is bended outwardly to form a bending portion, the bending portion resists the top of the flange, a first end of the cover body resists the bending portion, a second end of the heat dissipation cover defines a through hole for the wiring pipe extending through.

8. The lamp according to claim 1, wherein an edge of the first end of the cover body extends inwardly to form a first bending edge, the first bending edge resists the top of the flange.

9. The lamp according to claim 1, wherein an edge of the second end of the cover body extends inwardly to form a second bending edge, the second end of the spring resists the second bending edge.

10. A lamp, comprising:

a main body comprising a heat sink and a lamp holder located on a bottom of the heat sink, wherein the bottom of the heat sink extends outwardly to form a flange, the lamp holder has a trumpet shaped structure, a bottom of the lamp holder has an ellipse shape having a minor axis along a longitudinal direction and a major axis along a transverse direction;

a lighting assembly mounted to the bottom of the lamp holder;

a lampshade assembly comprising a cover body covering the lamp holder and a spring located in the cover body, wherein the spring surrounds the lamp holder, the cover body comprises a first end and a second end opposite to the first end, the first end and the second end each extends inwardly to form an annular portion, an inner diameter of the second end of the cover body is greater the major axis of the bottom of the lamp holder, the first end of the cover body resists a top of the flange, the spring is clamped between the flange and the second end of the cover body; and a reflector cover, wherein a top end of the reflector cover comprises a sleeving portion extending radically and an embedded portion axially extending upward from an inner edge of the sleeving portion, an inner diameter of the embedded portion is less than the major axis of the bottom of the lamp holder, and is greater than the minor axis, which facilitates the lamp holder to extend into the reflector cover when the embedded portion is inclined for a predetermined angle, and wherein, at the predetermined angle, a projection of the inner diameter of the embedded portion is greater than the major axis of the bottom of the lamp holder so that the reflector cover can be sleeved on the bottom of the lamp holder.

* * * * *